US009988229B2

(12) United States Patent
Perini

(10) Patent No.: US 9,988,229 B2
(45) Date of Patent: Jun. 5, 2018

(54) DEVICE AND METHOD FOR CONTROLLING THE DISCHARGE OF LOGS FROM A REWINDING MACHINE

(71) Applicant: FUTURA S.P.A., Capannori (LU), Fraz. Guamo (IT)

(72) Inventor: Fabio Perini, Viareggio (IT)

(73) Assignee: FUTURA S.P.A., Fraz Guamo (IT)

( * ) Notice: Subject to any disclaimer, the term of this patent is extended or adjusted under 35 U.S.C. 154(b) by 97 days.

(21) Appl. No.: 14/912,483

(22) PCT Filed: Aug. 13, 2014

(86) PCT No.: PCT/IT2014/000221
§ 371 (c)(1),
(2) Date: Feb. 17, 2016

(87) PCT Pub. No.: WO2015/040644
PCT Pub. Date: Mar. 26, 2015

(65) Prior Publication Data

US 2016/0200539 A1 Jul. 14, 2016

(30) Foreign Application Priority Data

Sep. 23, 2013 (IT) ..... FI2013A0221

(51) Int. Cl.
*B65H 19/30* (2006.01)

(52) U.S. Cl.
CPC ..... *B65H 19/30* (2013.01); *B65H 2301/4172* (2013.01); *B65H 2301/41447* (2013.01)

(58) Field of Classification Search
CPC ..... B65H 19/22; B65H 19/29; B65H 19/30; B65H 2301/4172; B65H 2301/414421; B65H 2301/41445; B65H 2301/41447
See application file for complete search history.

(56) References Cited

U.S. PATENT DOCUMENTS

| | | | | |
|---|---|---|---|---|
| 3,757,927 | A * | 9/1973 | Gable | B23B 13/10 198/463.5 |
| 5,257,898 | A * | 11/1993 | Blume | B65H 19/29 156/357 |
| 6,565,033 | B1 | 5/2003 | Biagiotti | |
| 6,779,649 | B2 * | 8/2004 | Woodham | B65G 25/08 198/459.5 |

(Continued)

FOREIGN PATENT DOCUMENTS

| | | |
|---|---|---|
| EP | 0 528 121 A1 | 2/1993 |
| EP | 0 541 496 A1 | 5/1993 |

(Continued)

*Primary Examiner* — William A. Rivera
(74) *Attorney, Agent, or Firm* — McGlew and Tuttle, P.C.

(57) ABSTRACT

Device for controlling the discharge of Logs outgoing from a rewinding machine, comprising a body (6) placed downstream of a surface (5) along which the logs (3) move in a output direction (F), wherein said body (6) rotates with a predetermined angular speed about an axis (a) parallel to the logs (3) and perpendicular to said output direction (F) followed by the Logs (3). The body (6) has at least one pocket (P) adapted to receive and temporarily housing a log (3) that enters in the same pocket (P) while moving along the said output direction (F). The body (6) rotates about said axis (a) in a direction (G) opposite to the output direction.

20 Claims, 4 Drawing Sheets

(56) References Cited

U.S. PATENT DOCUMENTS

Figure 1:
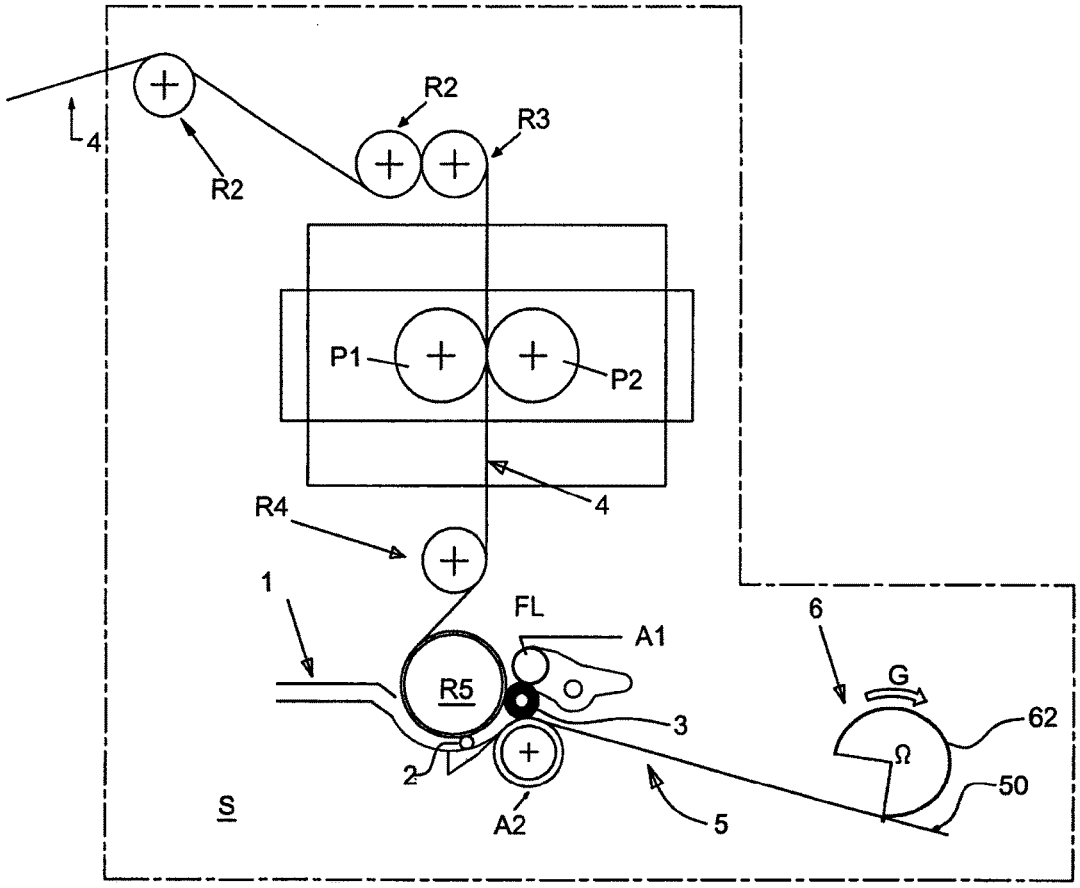
Figure 2:
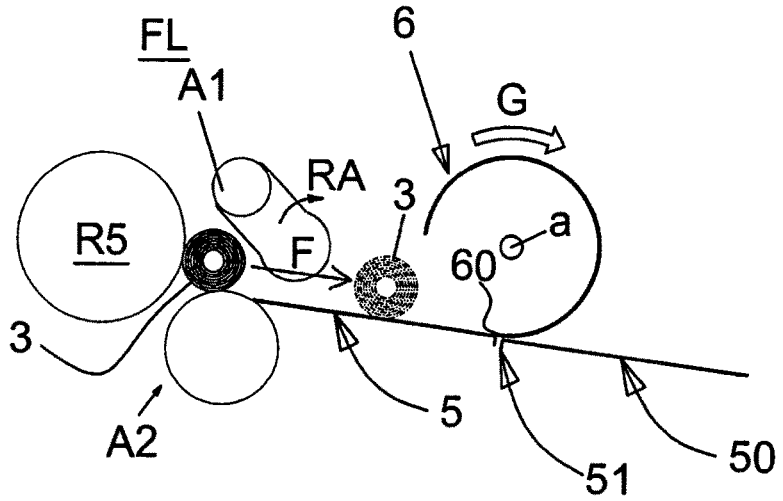

| | | | | |
|---|---|---|---|---|
| 6,877,689 | B2 * | 4/2005 | Butterworth | B65H 19/2269 242/533.1 |
| 6,978,879 | B2 * | 12/2005 | Woodham | B07C 5/14 144/250.25 |
| 7,175,127 | B2 * | 2/2007 | Butterworth | B65H 19/2269 242/533.1 |
| 7,198,221 | B2 | 4/2007 | Betti et al. | |
| 8,807,326 | B2 * | 8/2014 | Krauss | B27B 31/00 198/463.6 |
| 2003/0001042 | A1 | 1/2003 | Betti et al. | |
| 2008/0271869 | A1 | 11/2008 | Tsai | |

FOREIGN PATENT DOCUMENTS

| | | | |
|---|---|---|---|
| EP | 867 392 | A1 | 9/1998 |
| EP | 1 524 218 | A1 | 4/2005 |
| EP | 1520814 | A2 | 4/2005 |
| WO | 01/64563 | A2 | 9/2001 |

* cited by examiner

DEVICE AND METHOD FOR CONTROLLING THE DISCHARGE OF LOGS FROM A REWINDING MACHINE

The present invention relates to a device and a method for controlling the discharge of logs from a rewinding machine.

It is known that the so-called "rewinders" are used for winding a predetermined amount of paper or other web material around a tubular core, usually made of cardboard, so as to produce paper reels, commonly called "logs", having a predetermined diameter.

The winding of the web material on the core is made in a station provided with a pair of winding rollers by means of which the logs are retained and made to rotate about the longitudinal axis of the core until the logs reach the required diameter.

Rewinding machines of this type are described, for example, in U.S. 2003/0001042 A1, U.S. Pat. No. 6,565,033 and WO 01/64563.

Once the winding is complete, the log must leave the rewinder to be led to other processing steps. For this purpose, the log is released from the winding rollers and is thus free to roll along an outlet or discharge plane. However, there is the need to slow down the logs coming out of the rewinder.

Examples of devices for controlling the discharge of logs from a rewinding machine are disclosed in U.S. Pat. No. 7,198,221, EP 867 392 and EP 1520814.

The main purpose of the present invention is to propose a device to effectively control the discharge of the logs while avoiding the damage of the same.

This result is achieved, according to the present invention, by adopting the idea of realizing a device and implement an operating method having the characteristics indicated in the independent claims. Other features of the invention are the subject of the dependent claims.

The advantages deriving from the present invention consist essentially in that it is possible to control very effectively the speed of discharge or exit of the logs from the rewinder; that it is possible to preserve the integrity of the logs thus controlled; that an apparatus according to the invention is simple, cheap and reliable even after a prolonged period of operation.

Figure 3:
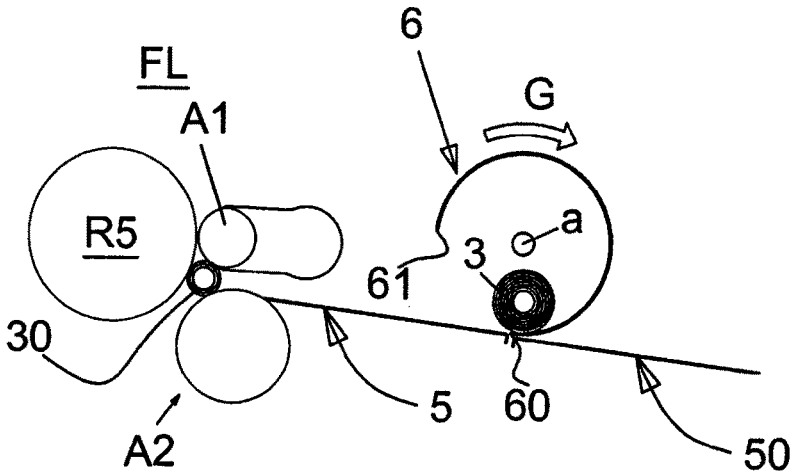
Figure 4:
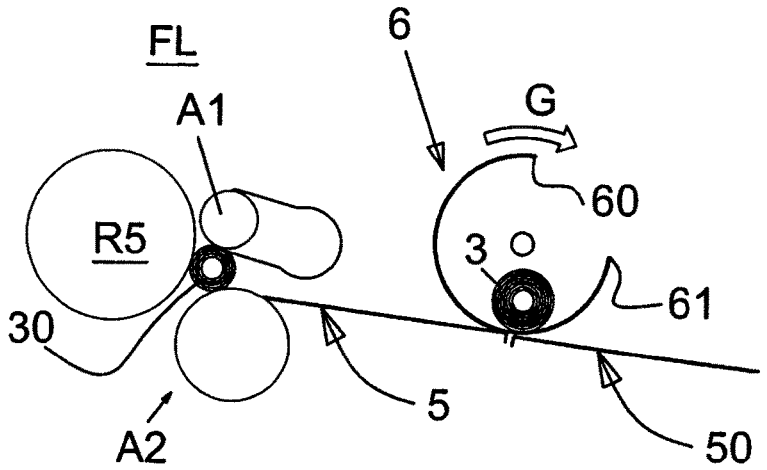
Figure 7:
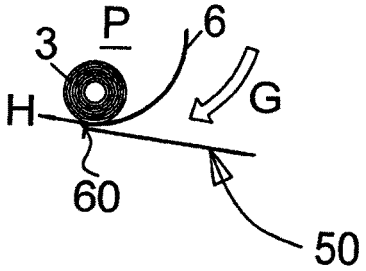
Figure 8:
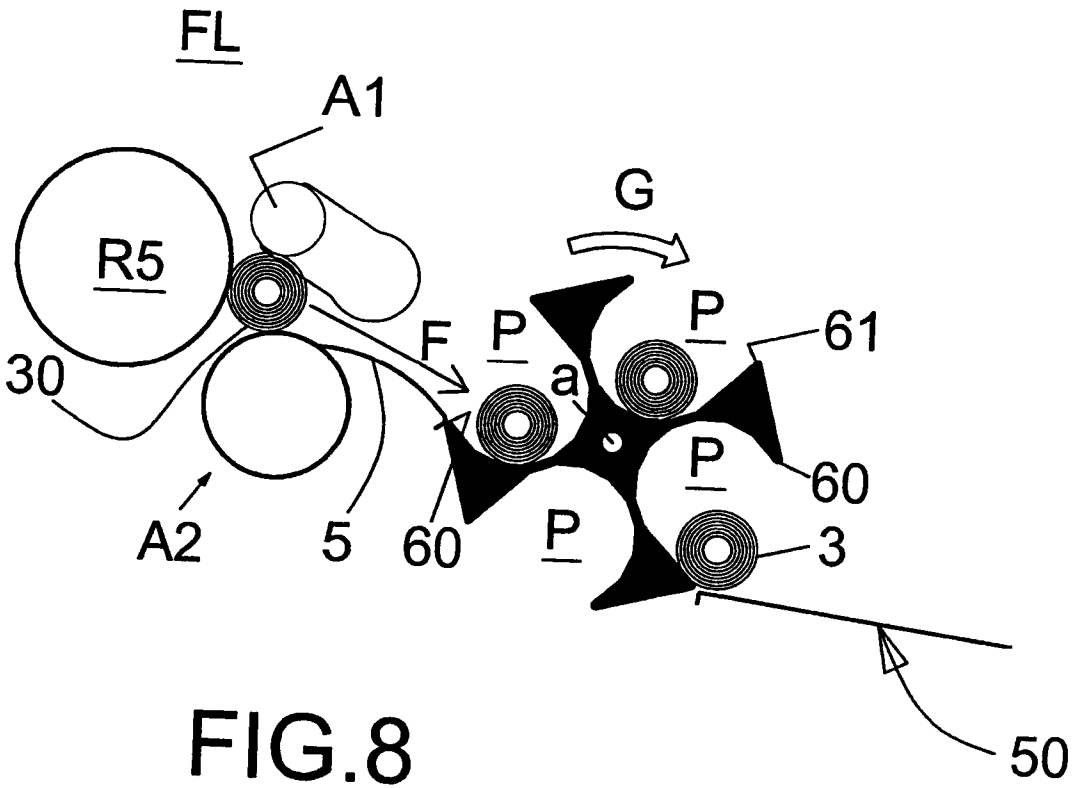

These and other advantages and features of the present invention will be best understood by anyone skilled in the art from the following description and with the help of the attached drawings given as a practical exemplification of the invention, but not to be considered in a limiting sense, wherein:

FIG. 1 schematically represents a rewinding machine provided with a control device in accordance with the invention;

FIGS. 2-6 schematically represent a device according to the invention in different operating phases;

FIG. 7 represents a particular of FIG. 3 with parts omitted to better illustrate others;

FIG. 8 schematically represents a further embodiment of a device according to the invention.

FIG. 1 schematically shows, only to allow identification of the position of the device object of the invention, the following components of a rewinding machine:

- a unit (1) for feeding the cores (2) around which the logs are formed (3);
- a plurality of rollers (R1, R2, R3, R4, R5) for feeding a paper web (4);

- two perforating rollers (P1, P2) to produce, upstream of a station (FL) for the formation of the logs, a series of equally spaced transverse perforations on the paper web (4);
- two winding rollers (A1, A2) disposed and acting in correspondence of said station (FL) for formation of the logs;
- an inclined plane (5) on which the logs (3) can roll after having been released from the winding rollers (A1, A2): said inclined plane (5) being downstream of the said logs formation station (FL);
- a fixed structure (S) that supports said components.

The operation of a machine thus structured is known to those skilled in the art and, therefore, will not be described in greater detail.

The web (4) may consist of a single ply or more superimposed plies.

A device for controlling the discharging or output speed of the logs (3) coming out of a rewinding machine according to the invention comprises a rotatable body (6) arranged above the said plane (5) downstream of said winding rollers (A1, A2), with axis (a) parallel to the axis of the latter, that is, with axis parallel to that of the logs (3) exiting from the rewinding machine. In the attached drawings, said axis (a) is horizontal and parallel to the plane (5) along which roll the logs formed in the station (FL), i.e., is orthogonal to the direction (F) of the logs (3) leaving the station (FL).

Said body (6) is controlled by a corresponding electric motor (not shown) which controls its rotation with a predetermined angular speed about the respective longitudinal axis.

As shown in FIGS. 1-6, said body (6), intended to slow down the motion of the log (3) downstream of station (FL), is a body that picks up the log (3) on the plane (5), dissipates its kinetic energy and places it on an extension (50) of the same plane (5) downstream of the pickup point (51) that is on the trailing edge of the plane (5).

The body (6) has a lateral concave surface (62), with the concavity facing inwards, which in the example illustrated in FIGS. 2-6, is a portion of cylindrical surface whose cross section has the shape of a circular arc of angular amplitude (Q) greater than 180° and preferably between 180° and 270°.

Figure 5:
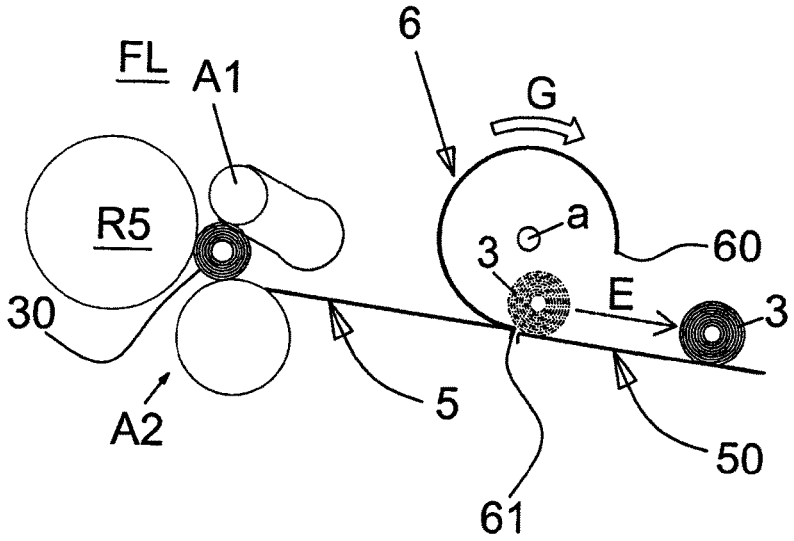
Figure 6:
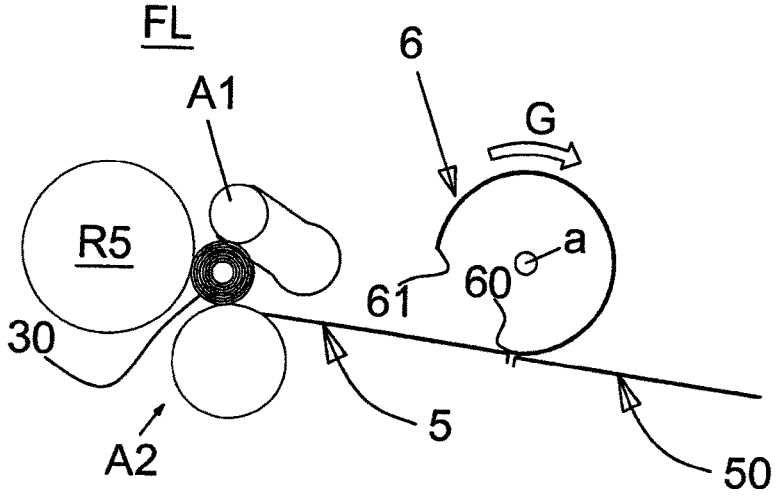

FIGS. 2-6 represent a sequence of positions assumed by the body (6) during the operation of the present device: in a first phase (FIG. 2), the log (3), the formation of which has just ended, is freed from the roller (A1) as indicated by arrow "RA" and therefore it rolls on the plane (5) and enters into the concavity of the body (6), as indicated by arrow "F", suitably positioned with its front edge (60) at the point (51) where the logs are taken. Subsequently (FIGS. 3 and 4), while the body (6) rotates as indicated by arrow "G", another log (30) is formed in the station (FL) and the log (3) previously freed lies in the concavity of the body (6). In this phase, the motion of the log (3) is not free but is controlled by the body (6) that rotates with a predetermined angular speed about the axis (a). With the further rotation of the body (6) the rear edge (61) of the latter is positioned above the said pickup point (51), as shown in FIG. 5. With the body (6) thus positioned, the log (3) is free to leave and to roll on the extension (50) of the plane (5). At that instant, the log (3) is substantially stationary relative to the plane (50). In FIG. 5 the log (3) drawn with dashed lines is at the time in which it is released from the body (6) and the arrow "E" indicates the exit of the log (3) from the latter. In FIG. 6 the body (6) is in a position identical to that of FIG. 2, that is, ready to receive another log.

As shown in FIGS. 2-6, the location of the log (3) inside the body (6) is substantially fixed with respect to the discharge plane (5, 50). In fact, while the body (6) rotates around its own axis (a), the log (3) rolls freely on the inner wall of its lateral surface (62) and remains substantially above the aforesaid pickup point (51).

The direction of rotation (G) of the body (6) is such that its front edge (60), when it is in correspondence of the pickup point (51), moves in the direction opposite to the direction (F) from which the logs (3) come. Moreover, the body (6) is positioned with respect to the plane (5) in such a way that its front edge (60) is substantially at the same height of the pickup point (51) in the phase in which a log (3) exiting from the station (FL) has to be taken.

In other words, the body (6), rotating in a direction (G) opposite to the direction (F) from which from the logs (3) arrive, receives the latter and houses them temporarily in the pocket (P) delimited by the inner wall of its lateral surface (62), allowing the same logs to roll freely inside of said pocket, without translating, for all the time required by the completion of a turn of the body (6) around the axis (a).

The said movement of the front edge (60) of the body (6) is represented by the arrow "H" in FIG. 7. In the same FIG. 7 can be seen the bevel of said edge (60). Note that the directions indicated by arrows "H" and "F" are mutually opposite.

In the example described above the body (6) has a single pocket (P) for accommodating the logs (3).

In the example illustrated in FIG. 8 the body (6) has a plurality of pockets (P) each adapted to receive a log (3) coming from the station (FL). Also in this example, the body (6) rotates around an axis (a) parallel to the logs (3) in a direction (G) opposite to that (F) of origin of the same logs. The operation is completely analogous to that described above, with the difference that in this case the body (6) carries more logs (3) at the same time instead of only one log, and that during transport operated by the body (6), the logs (3) do not remain constantly above of the pickup point. Owing to the greater transverse extension of the body (6), the latter is disposed between the planes (5) and (50) that in this case are not adjacent but separated from each other by the body (6).

The surface of the logs (3) will not be damaged even if their speed is reduced as desired.

The rotation of the body (6) is properly synchronized with the production of the logs in the station (FL).

A method o in accordance with the present invention involves the production of logs (3) formed by a roll obtained from a web of paper material in a corresponding station (FL) of a rewinding machine, the discharge of the logs (3) from said station (FL) along a predetermined discharge direction (F), and the collection of logs (3) in a predetermined pickup point (51) with a container body (6) that at said pickup point (51) moves along a direction (G) opposite to said discharge direction (F) of the logs (3).

In practice the details of execution may vary in any equivalent way as for what concerns the elements described and illustrated and their disposition, without leaving the scope of the adopted solution and thus remaining within the limits of the protection granted to the present patent.

The invention claimed is:

1. A device for controlling a discharge of logs outgoing from a rewinding machine, the device comprising:

a body placed downstream of a surface along which the logs move in an output direction, wherein said body rotates with a predetermined angular speed about an axis parallel to the logs and perpendicular to said output direction followed by the logs, said body having at least one pocket adapted to receive and temporarily house a log that enters at a first speed in the pocket while moving along said output direction, and said body rotates about said axis in a direction opposite to the output direction followed by the logs, said at least one pocket having a concave shape allowing the pocket to house the log entered therein while the log is moved by said body from a pickup point of the logs at a release point downstream of the pickup point, said body being rotated about said axis at an angular speed such that the logs have a second speed when the logs are released at said release point, said second speed being lower than that said first speed, said release point being provided at an extension of said surface.

2. A device according to claim 1, wherein said body comprises a single pocket.

3. A device according to claim 2, wherein said pocket is delimited by a concave surface with a cross-section having a shape of a circular arc of angular extension comprised between 180° and 270°.

4. A device according to claim 2, wherein the log received in the pocket remains at a substantially constant height while the body rotates around the axis.

5. A device according to claim 1, wherein said body has another pocket to provide a plurality of pockets.

6. A device according to claim 5, wherein each of said pockets has a front edge that, when said front edge is in correspondence with a pickup point of the logs, moves in the direction opposite to the output direction followed by the logs.

7. A device according to claim 5, wherein the logs are free to roll on inner walls of said pockets.

8. A device according to claim 1, wherein said at least one pocket has a front edge that, when said front edge is in correspondence with a pickup point of the logs, moves in the direction opposite to the output direction followed by the logs.

9. A device according to claim 1, wherein said body has only a single opening.

10. A device according to claim 1, wherein the surface extends continuously, without interruption, from one end of the surface to another end of the surface.

11. An operating method for controlling a discharge of logs outgoing from a rewinding machine, comprising a production of logs formed by a roll made by a web of paper material in a corresponding station of the rewinding machine and unloading of the logs from said station, forcing the logs to move along a predetermined output direction over an output surface, the method comprising:

collecting the logs in a predetermined pickup point, downstream of said station, with a containing body that at said pickup point moves along a direction opposite to the output direction followed by the logs and releases the logs at a release point downstream of the pickup point, the logs having a first speed at the predetermined pickup point, the logs having a second speed when the logs are released at the release point, said second speed being lower than said first speed, said release point being provided at an extension of said output surface.

12. An operating method according to claim 11, wherein said containing body has only a single opening.

13. An operating method according to claim 12, wherein the output surface extends continuously, without interruption, from one end of the output surface to another end of the output surface.

14. A device for controlling a discharge of logs outgoing from a rewinding machine, the device comprising:

a body placed downstream of a surface along which the logs move in an output direction, wherein said body rotates with a predetermined angular speed about an axis parallel to the logs and perpendicular to said output direction followed by the logs, said body having a single opening and an inner surface having a first end portion and a second end portion, said inner surface extending continuously, without interruption, from said first end portion to said second end portion in a circumferential direction with respect to said axis, said first end portion and said second end portion defining said single opening, said inner surface defining at least one pocket adapted to receive and temporarily house a log that enters the pocket while moving along said output direction, and said body rotating about said axis in a direction opposite to the output direction followed by the logs.

15. A device according to claim 14, wherein said at least one pocket has a concave shape allowing the pocket to house the log entered therein while the log is moved by said body from a pickup point of the logs at a release point downstream of the pickup point, said body being rotated about said axis at an angular speed such that the logs have a second speed when the logs are released at said release point, said second speed being lower than that said first speed, said release point being provided at an extension of said surface.

16. A device according to claim 14, wherein said inner surface comprises a concave surface with a cross-section having a shape of a circular arc of angular extension comprised between 180° and 270°.

17. A device according to claim 14, wherein the log received in the pocket remains at a substantially constant height while the body rotates around the axis.

18. A device according to claim 14, wherein said body has another pocket to provide a plurality of pockets.

19. A device according to claim 18, wherein each of said pockets has a front edge that, when said front edge is in correspondence with a pickup point of the logs, moves in the direction opposite to the output direction followed by the logs.

20. A device according to claim 18, wherein the logs are free to roll on inner walls of said pockets.

* * * * *